US010392834B2

(12) United States Patent
Hodgson

(10) Patent No.: US 10,392,834 B2
(45) Date of Patent: Aug. 27, 2019

(54) SAFETY TRAPPED KEY INTERLOCK SYSTEM

(71) Applicant: ENEX Group Ltd, Middlesbrough, Cleveland (GB)

(72) Inventor: Wayne Hodgson, Middlesbrough (GB)

(73) Assignee: ENEX GROUP LTD.

( * ) Notice: Subject to any disclaimer, the term of this patent is extended or adjusted under 35 U.S.C. 154(b) by 0 days.

(21) Appl. No.: 15/735,438

(22) PCT Filed: Jun. 10, 2016

(86) PCT No.: PCT/GB2016/051727
§ 371 (c)(1),
(2) Date: Dec. 11, 2017

(87) PCT Pub. No.: WO2016/198888
PCT Pub. Date: Dec. 15, 2016

(65) Prior Publication Data

US 2018/0179784 A1 Jun. 28, 2018

(30) Foreign Application Priority Data

Jun. 10, 2015 (GB) ..... 1510145.4

(51) Int. Cl.
*E05B 35/14* (2006.01)
*E05B 19/18* (2006.01)
(Continued)

(52) U.S. Cl.
CPC ..... *E05B 35/14* (2013.01); *E05B 11/005* (2013.01); *E05B 11/02* (2013.01); *E05B 15/06* (2013.01);
(Continued)

(58) Field of Classification Search
CPC ..... E05B 35/14; E05B 19/0023; E05B 15/06; E05B 19/0047; E05B 11/005;
(Continued)

(56) References Cited

U.S. PATENT DOCUMENTS 722,325 A * 3/1903 Plowden
1,022,900 A * 4/1912 Von Vargyas ..... E05B 19/18 70/408
(Continued)

FOREIGN PATENT DOCUMENTS

DE 1025754 3/1958
FR 1165830 10/1958
(Continued)

OTHER PUBLICATIONS

Corresponding International Search Report and Written Opinion for PCT/GB2016/051727 dated Dec. 1, 2016. WO.
UK Search Report for GB1610169 dated Dec. 22, 2016. GB.

*Primary Examiner* — Lloyd A Gall
(74) *Attorney, Agent, or Firm* — The Belles Group, P.C.

(57) ABSTRACT

A trapped key interlock system is disclosed. A pair of hollow tubular casings located one inside the other and each having a series of elongate slots are used. When the lock is in a locked condition the elongate slots are aligned as inner and outer pairs with engaging members extending through the pairs of slots is preventing rotational movement of the tubular casings relative to each other. The engaging members are biased towards this locked condition. On insertion of the correctly coded key the engaging members are caused to move against the biasing force out of engagement with the slots in the outer tubular casing thereby allowing the inner tubular casing to rotate relative to the outer tubular casing and moving the lock to an unlocked condition.

9 Claims, 8 Drawing Sheets

(51) Int. Cl.

| | |
|---|---|
| ***E05B 29/00*** | (2006.01) |
| ***E05B 11/00*** | (2006.01) |
| ***E05B 11/02*** | (2006.01) |
| ***E05B 15/06*** | (2006.01) |
| ***E05B 19/00*** | (2006.01) |

(52) U.S. Cl.
CPC ..... *E05B 19/0023* (2013.01); *E05B 19/0047* (2013.01); *E05B 19/18* (2013.01); *E05B 29/004* (2013.01); *E05B 29/0033* (2013.01)

(58) Field of Classification Search
CPC .... E05B 11/02; E05B 29/004; E05B 29/0033; E05B 19/18; E05B 35/003; E05B 35/005; E05B 35/125; E05B 19/0035; E05B 29/0046; E05B 29/0073; E05B 29/008
USPC ..... 70/389, 390, 420, 429, 430, 401, 403, 70/404, 409–412, DIG. 2, DIG. 25, 70/DIG. 28, DIG. 29, 492, 495, 377, 392, 70/395
See application file for complete search history.

(56) References Cited

U.S. PATENT DOCUMENTS 1,107,376 A * 8/1914 Thiman ..... E05B 29/00 70/377
1,218,065 A * 3/1917 Diesel ..... E05B 29/00 70/377
1,280,633 A * 10/1918 Baird ..... E05B 29/00 70/379 A
1,823,411 A * 9/1931 Schori ..... E05B 21/06 70/377
1,836,425 A * 12/1931 Aaltonen ..... E05B 67/10 70/18
1,990,014 A * 2/1935 Alcorn ..... E05B 13/108 70/118
2,038,677 A * 4/1936 Recht ..... E05B 19/18 70/358
2,151,245 A * 3/1939 Swilens ..... E05B 21/063 70/376
2,356,891 A * 8/1944 Seiffert ..... E05B 19/18 70/395
2,430,914 A * 11/1947 Ciani ..... E05B 19/18 70/411
2,462,954 A * 3/1949 Frizzell ..... E05B 27/00 70/358
2,803,959 A * 8/1957 Schlage ..... E05B 27/00 70/347
2,894,082 A * 7/1959 Collotta ..... H01H 27/06 200/43.08
3,555,859 A 1/1971 Berkowitz
3,637,180 A * 1/1972 Parry ..... A47B 81/005 211/64
3,797,292 A * 3/1974 Taylor ..... E05B 19/0029 70/409
3,798,398 A * 3/1974 Hills ..... E05B 11/00 307/10.3
4,069,693 A * 1/1978 Spalding ..... E05B 29/00 70/377
4,232,539 A * 11/1980 Lo ..... E05B 21/063 70/409
4,287,735 A * 9/1981 Brunken ..... E05B 19/18 70/395
4,516,417 A * 5/1985 Parrock ..... E05B 35/083 70/377
4,682,484 A 7/1987 Yeh
5,778,712 A * 7/1998 Wallden ..... E05B 15/08 70/407
9,359,792 B1 * 6/2016 Liao ..... E05B 27/005
2005/0061042 A1 * 3/2005 Lin ..... E05B 21/063 70/492
2005/0262907 A1 * 12/2005 Johansson ..... E05B 27/0053 70/137
2007/0151316 A1 * 7/2007 Bardachenko ..... E05B 29/00 70/492
2013/0104610 A1 * 5/2013 Adolfsson ..... E05B 19/18 70/492
2015/0114056 A1 4/2015 Liao

FOREIGN PATENT DOCUMENTS

| | | |
|---|---|---|
| FR | 2396853 | 2/1979 |
| FR | 2426135 | 12/1979 |
| GB | 1273119 | 5/1972 |
| RU | 2118435 | 8/1998 |

* cited by examiner

SAFETY TRAPPED KEY INTERLOCK SYSTEM

CROSS-REFERENCE TO RELATED APPLICATIONS

This application is a U.S. national stage application under 35 U.S.C. § 371 of PCT Application No. PCT/GB2016/051727, filed Jun. 10, 2016, which claims priority to GB Application No. 1510145.4, filed Jun. 10, 2015, the entireties of which are incorporated herein by reference.

The present invention relates to an improved lock and relates particularly, but not exclusively, to a mechanical trapped key safety interlock for preventing operator human errors occurring during apparatus and equipment operating procedures.

A conventional cylinder lock comprises an outer casing having a cylindrical bore therethrough. A plug is housed in the cylindrical bore. In order to open the lock, the plug must rotate in the cylindrical bore.

One end of the plug comprises a shaped aperture known as the key slot. A suitably shaped key fits in the key slot. The other end of the plug has a lever which activates a mechanism to retract a locking bolt from a recess. A series of bores, typically five or six of them, are radially drilled into the plug. These bores each contain pins called differ pins, which are of various lengths, and which are rounded at one end to permit a key to easily radially outwardly displace them when the key is inserted into the key slot.

Above each differ pin is a corresponding driver pin, which is spring-loaded by means of springs. The outer casing also has several radial bores which communicate with the bores of the plug and which house the spring-loaded driver pins.

With a properly shaped key inserted into the key slot of the plug, the pins will move radially outwardly, and because the length of the pins is specially designed to match the shape of the key, the junction between each differ pin and each driver pin will exactly align with the shear line which is defined by the border between the plug and the cylindrical bore. This alignment allows the key and therefore the plug with it, to rotate, thereby retracting the locking bolt from the recess and opening the lock.

When the correct key is not in the key slot, the pins are pushed down into the plug by the springs and the driver pins straddle the shear line, thereby preventing the plug from rotating, thereby keeping the lock closed.

Despite being a commonly used lock and key arrangement, the arrangement described above includes a number of disadvantages.

A common usage of locking devices are in systems using interlocks. These interlocks are commonly used to ensure that apparatus is operated safely. For example a trapped key interlock operates as follows, a robotic apparatus may be enclosed within a cage to ensure that operators cannot come into contact when the robotic apparatus is in use. A single key for an interlock is provided which is required to both operate a control panel outside the safety cage and to open a door in the cage. When the key is in the control panel and turned to an operating condition the key cannot be removed. In order to enter the cage the operator must turn the key to a non-operating condition on the control panel to remove the key before inserting it into the cage door locking mechanism where it is retained when the cage door is unlocked.

The keys for such interlocks are generally large and robust but often lack very secure features and can be easily overcome. For example, most interlock keys have their key coding removed by simple machining processes to create a the coding making it very easy to overcome the safety device provided by the interlock by removing more material to alter the coding or even produce master keys.

Preferred embodiments of the present invention seek to overcome or at least alleviate the disadvantages of the prior art.

In accordance with a first aspect of the present invention, there is provided a lock movable between a locking and an unlocking condition, comprising:—

(i) a first hollow tubular casing;

(ii) a second hollow tubular casing disposed within the hollow portion of the first hollow casing; and (iii) a lock portion mounted within the second hollow casing, wherein the lock portion comprises a plurality of annular elements arranged side by side, each said annular element comprising an engaging member extending radially outwards from the periphery of the annular element, and wherein the first hollow casing comprises a plurality of first elongate notches extending substantially along the length of the first hollow casing, each first elongate notch disposed at a predetermined position on the periphery of the first hollow casing, and wherein the second hollow casing comprises a plurality of second elongate notches extending substantially along the length of the second hollow casing, each second elongate notch disposed at a predetermined position on the periphery of the second hollow casing such that, when said lock is in said locking condition, each of the first elongate notches substantially overlaps with a corresponding second elongate notch, and wherein each said engaging member is biased towards a position whereby said engaging member is disposed within one of said first elongate notches and its corresponding overlapping second elongate notch, defining said locking condition in which rotational movement of said second hollow casing within said first hollow casing is prevented, and wherein said lock is movable between said locking condition and an unlocking condition in which at least one said engaging member is disposed within a second elongate notch, but is not engaged with its corresponding overlapping first elongate notch, to allow for rotational movement of said second hollow casing within said first hollow casing.

Preferably, each said engaging member is biased towards the locking condition in which said engaging member is disposed within one of said first elongate notches and its corresponding second elongate notch, by means of a leaf spring.

Preferably, each said leaf spring is attached to said annular element and is disposed between the interior of said second hollow casing and said annular element at a position on said annular element diametrically opposite the engaging member of that annular element.

Alternatively, each said engaging member is biased towards the locking condition in which said engaging member is disposed within one of said first elongate notches and its corresponding second elongate notch, by means of a spring.

In this case, each said spring is mounted between the interior of said second hollow casing and one of said annular elements, at a position on said annular element diametrically opposite the engaging member of that annular element.

Preferably, said lock further comprises a key for moving said lock between said locking condition and said unlocking condition.

Preferably, said key comprises a cylindrical member comprising a plurality of biasing elements disposed on its outer surface.

Preferably, said key is adapted to be inserted into the second hollow casing such that, when said key is inserted into said second hollow casing, said lock moves towards the unlocking condition such that none of said engaging members are engaged with the first elongate notches.

Preferably, said plurality of biasing elements are disposed on said outer surface of said cylindrical member of said key such that, when said key is disposed in said lock, each said biasing element engages with a corresponding annular element such as to move said engaging member out of engagement with its corresponding first elongate notch.

Preferably, said plurality of biasing elements are disposed on said outer surface of said cylindrical member of said key such that, when said key is disposed in said lock, each said biasing element is disposed diametrically opposite the engaging member of the annular element with which the biasing element engages.

Preferably, said key further comprises a wedge shaped member attached to said cylindrical member, and said second hollow casing has a closed end comprising a correspondingly shaped slot such that, when the key has been disposed inside the second hollow casing, a portion of the wedge shaped member engages with the wedge shaped slot of the closed end, so that, when the key is rotated, the second hollow casing also rotates.

Preferably, the lock further comprises a key trapping element such that, in the event that the lock moves from its locking condition to its unlocking condition and the second hollow casing is rotated by means of turning said key, the key cannot be removed from the lock until the key and consequently the second hollow casing, is rotated back to the locking condition.

In this way, the lock operates as a trapped key lock, providing the advantage that the lock can be used in an environment where it is important for two valves not to be both opened at the same time, for example in an oil platform environment where it is important not to open two valves simultaneously. In this way, in the event that the first valve is to be opened, the key is inserted into the first lock and the first valve is opened. However, the key, which is also required to open the second valve, cannot be removed from the first lock until the first valve is closed once again, thereby preventing the second valve from being opened until the first valve has been closed.

This provides the further advantage that the lock can be used in an environment where valves have to be opened in a particular sequence. For example, the first valve could have two locks associated with it, and the second valve could also have two locks associated with it, such that the key from the second lock of the first valve is required to operate the first lock of the second valve. To elaborate, the first key is first inserted into the first lock of the first valve, and the first valve is opened. When the first valve is fully opened then this allows for removal of a second key that is already disposed in the second lock of the first valve, whilst trapping the first key in the first lock of the first valve. The second key that has been removed can then be inserted into the first lock of the second valve to open the second valve, thereby allowing for removal of a third key from the second lock of the second valve, and so on with further valves and their associated locks. In this way, the first valve has to be opened before the second valve, since, until the first valve is opened, the second key required to open the second valve, cannot be removed from the second lock of the first valve. Moreover, it is to be appreciated that if the first valve is not fully opened, then the first key cannot be removed from the first lock of the first valve, and nor can the second key be removed from the second lock of the first valve.

Preferably, said key trapping element comprises a disk disposed adjacent the closed end of the second hollow casing, said disk comprising a wedge shaped slot which, when said lock is in said locking condition, overlaps with said wedge shaped slot of said closed end of the second hollow casing.

Preferably, said disk is substantially fixed in position such that it does not rotate in the event that the second hollow casing is rotated by means of turning the key.

In this way, as the key is turned and the second hollow casing rotates within the first hollow casing towards the unlocking condition, the key becomes trapped, with the wedge shaped member of the key effectively becoming trapped between the closed end of the second hollow casing and the disk, in view of the fact that the slot of the disk is, at that stage, no longer overlapping with the slot of the closed end of the second hollow casing and is instead disposed cross-wise with it. Accordingly, the key remains trapped until such times that the key is turned back to the locking condition once again.

Preferably, said key includes a built in weakness, disposed at a position on the key adjacent the opposite end of the cylindrical member to the wedge shaped member.

This provides the advantage that, in the event that the key is forced, for example, by an unauthorised user using the wrong key for that particular lock, the key snaps at a position on the key distant from the wedge shaped element, thereby allowing for easy removal of the broken key from the lock, without the whole of the broken key becoming trapped in the lock.

In accordance with a second aspect of the present invention, there is provided a key for moving a lock in accordance with the present invention between said locking and said unlocking condition, wherein said key comprises a cylindrical member comprising a plurality of biasing elements disposed on its outer surface.

According to another aspect of the present invention there is provided a key comprising:— a handling portion for engagement by an operator;

a coding portion for engaging and moving a respective receiving portion of a lock mechanism between a locked and unlocked conditions;

a driving portion for transferring a rotational force applied to said handling portion to said lock causing a driven portion of said lock to rotate when in an unlocked condition, wherein said coding portion and said driving portion are axially separated along an axis of rotation of said key.

By axially separating the coding portion and driving portion of a key the advantage is provided that driven portion of the lock can be located as far away from the opening of the lock as possible meaning that even if a person is able to put the lock into an unlocking condition it will be extremely difficult to achieve this and apply the required rotational force to the driven portion of the lock. As a result, a lock with a large and robust key which is received into a lock with a large opening can be very secure and difficult to overcome.

In a preferred embodiment the handling portion is adjacent a first end of said key and said driving portion is adjacent a second end opposing said first end.

In another preferred embodiment the driving portion is shaped to fit through a correspondingly shaped aperture before engaging said driven portion.

According to a further aspect of the present invention there is provided a lock comprising:— a receiving portion movable between a locked and unlocked condition upon receiving a respective key having a correctly coded key portion;

a driven portion for engaging a driving portion of said key such that rotation of said driving portion causes rotation of said driven portion when said receiving portion is in an unlocked condition, wherein said receiving portion and said driven portion are axially separated along an axis of rotation of said lock.

In a preferred embodiment the driven portion is located in said lock as far from and entrance aperture as possible dependent on a length of said key.

The lock may further comprise a plate including an aperture correspondingly shaped to receive said driving portion of said key and located closer to said entrance aperture than said driven portion.

According to a still further aspect of the present invention there is provided a key comprising:— a handling portion for engagement by an operator;

a coding portion for engaging and moving a respective receiving portion of a lock mechanism between a locked and unlocked conditions, said coding portion including at least one fixing member and a plurality of coding members located axially along and rotationally fixed to said fixing member.

By providing a plurality of coding members located axially along and rotationally fixed to one or more fixing members the advantage is provided that these simple components can be used to make a robust key which co-operates with a lock which is extremely difficult to overcome.

In a preferred embodiment the coding members comprise a circular body portion and at least one protrusion extending radially outwardly therefrom.

A preferred embodiment of the present invention will now be described, by way of example only and not in any limitative sense, with reference to the accompanying drawings in which: —FIG. 1 shows an end view of a lock in accordance with an embodiment of the present invention;

Figure 1:
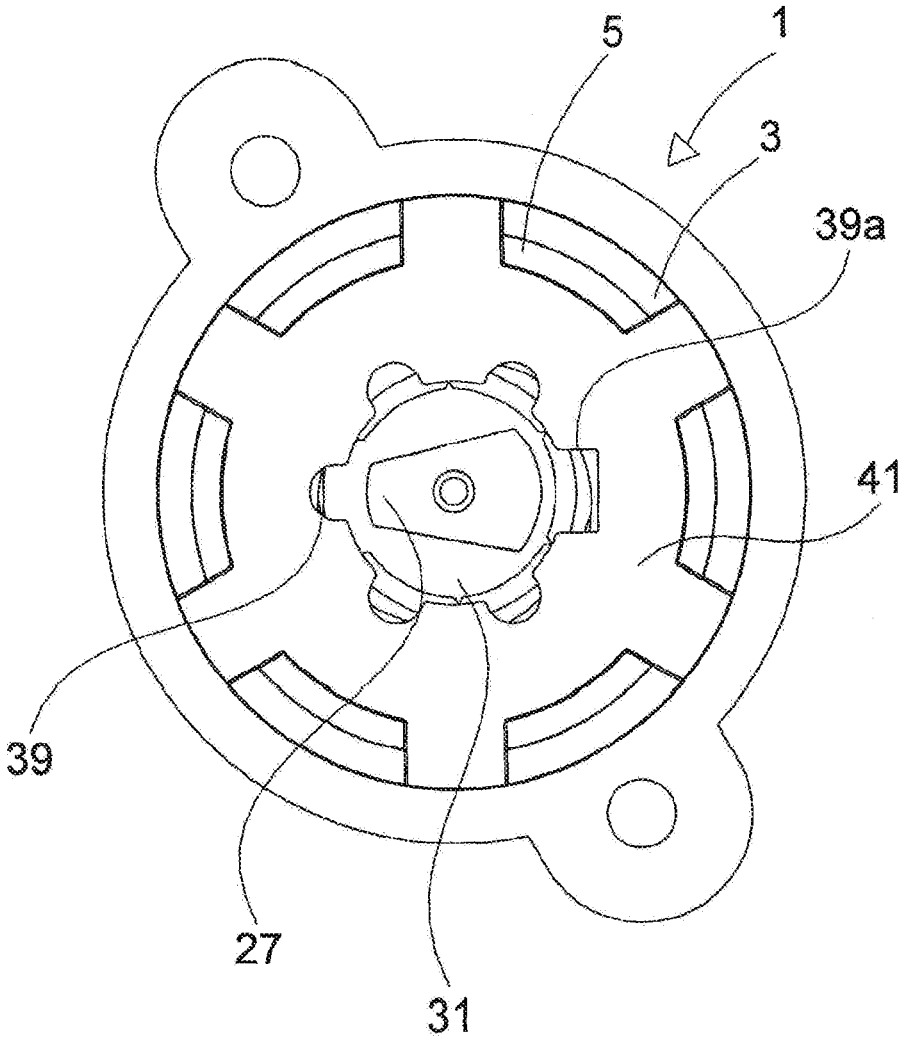
FIG. 1A shows an exploded perspective view of the lock of FIG. 1.
FIG. 1B shows a perspective view from one end of the lock of FIG. 1.

With reference to the Figures, a lock is represented generally by reference numeral 1.

The lock 1 comprises a first hollow tubular casing 3, and a second hollow tubular casing 5, which is disposed inside the hollow portion of the first hollow tubular casing 3. The lock 1 further comprises a lock portion 7 mounted within the second hollow tubular casing 5.

Figure 1A:
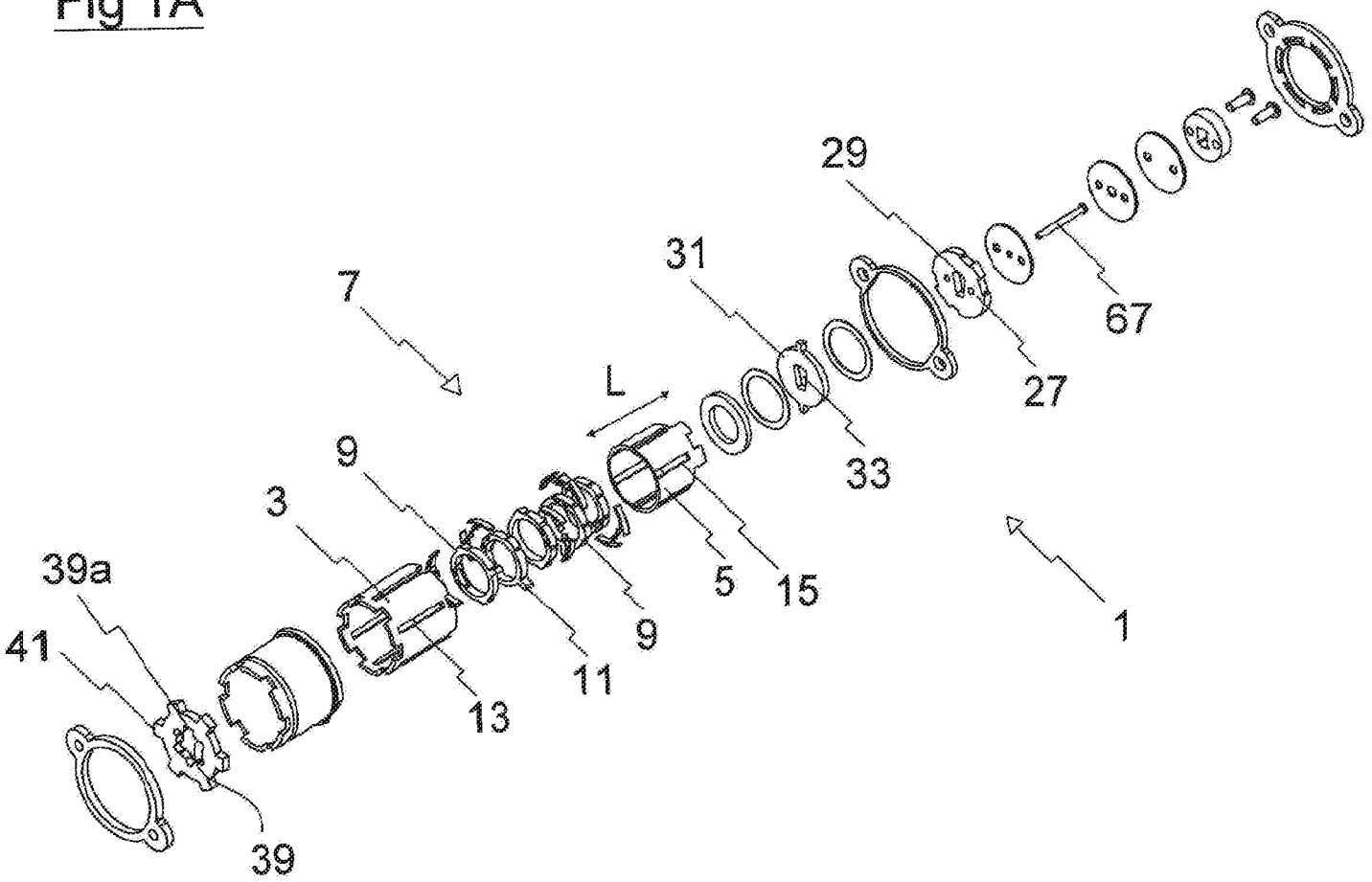
Figure 2:
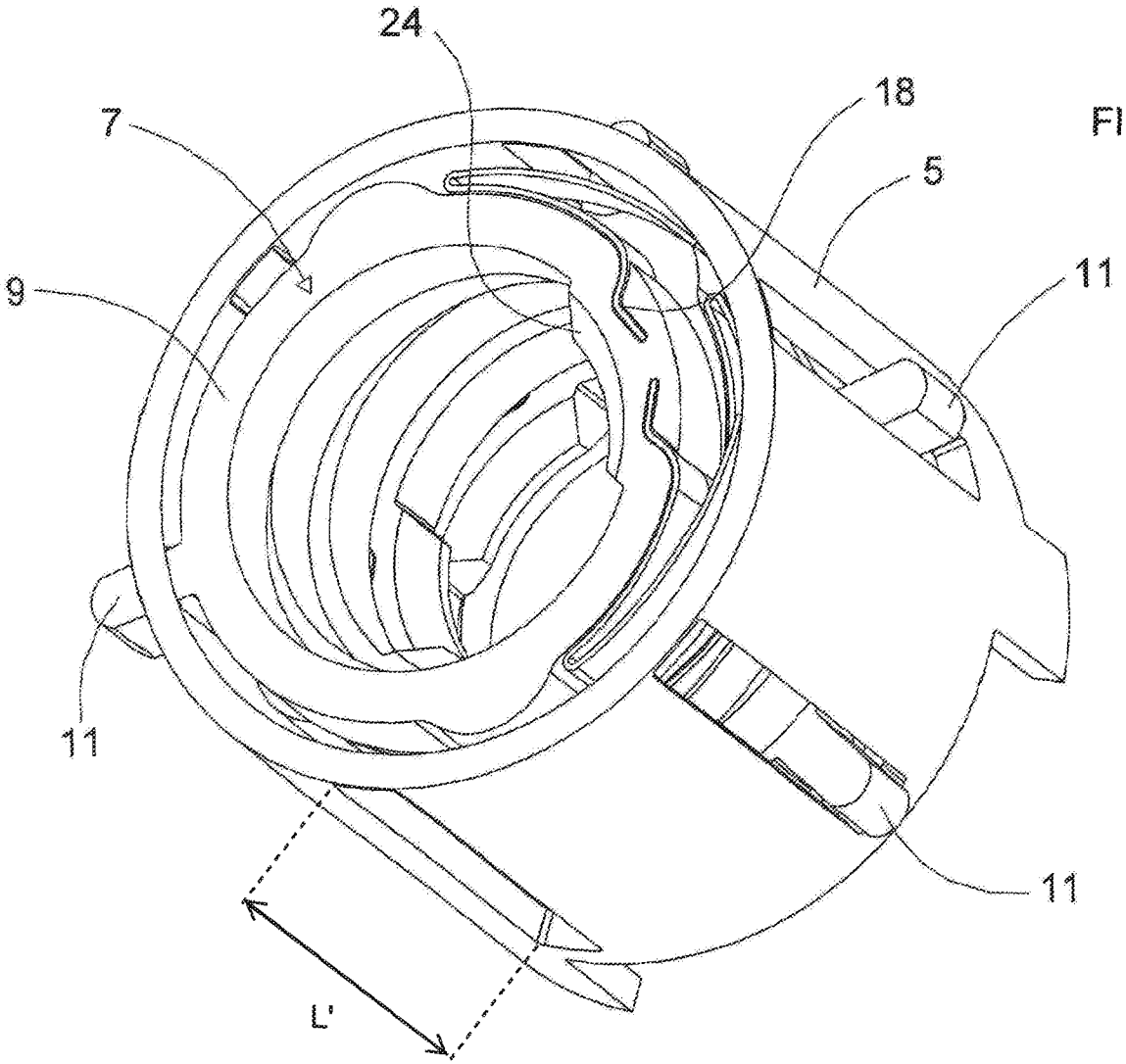
FIG. 2 shows a perspective view from one end and the side of the second hollow tubular casing and the annular elements of the lock of FIG. 1.

As can be clearly seen from FIGS. 1A and 2 in particular, the lock portion 7 comprises a plurality of annular elements 9 arranged adjacent to each other, side by side. Each annular element 9 comprises an engaging element in the form of an elongate tab 11 extending radially outwards from the periphery of the annular element 9.

Figure 4:
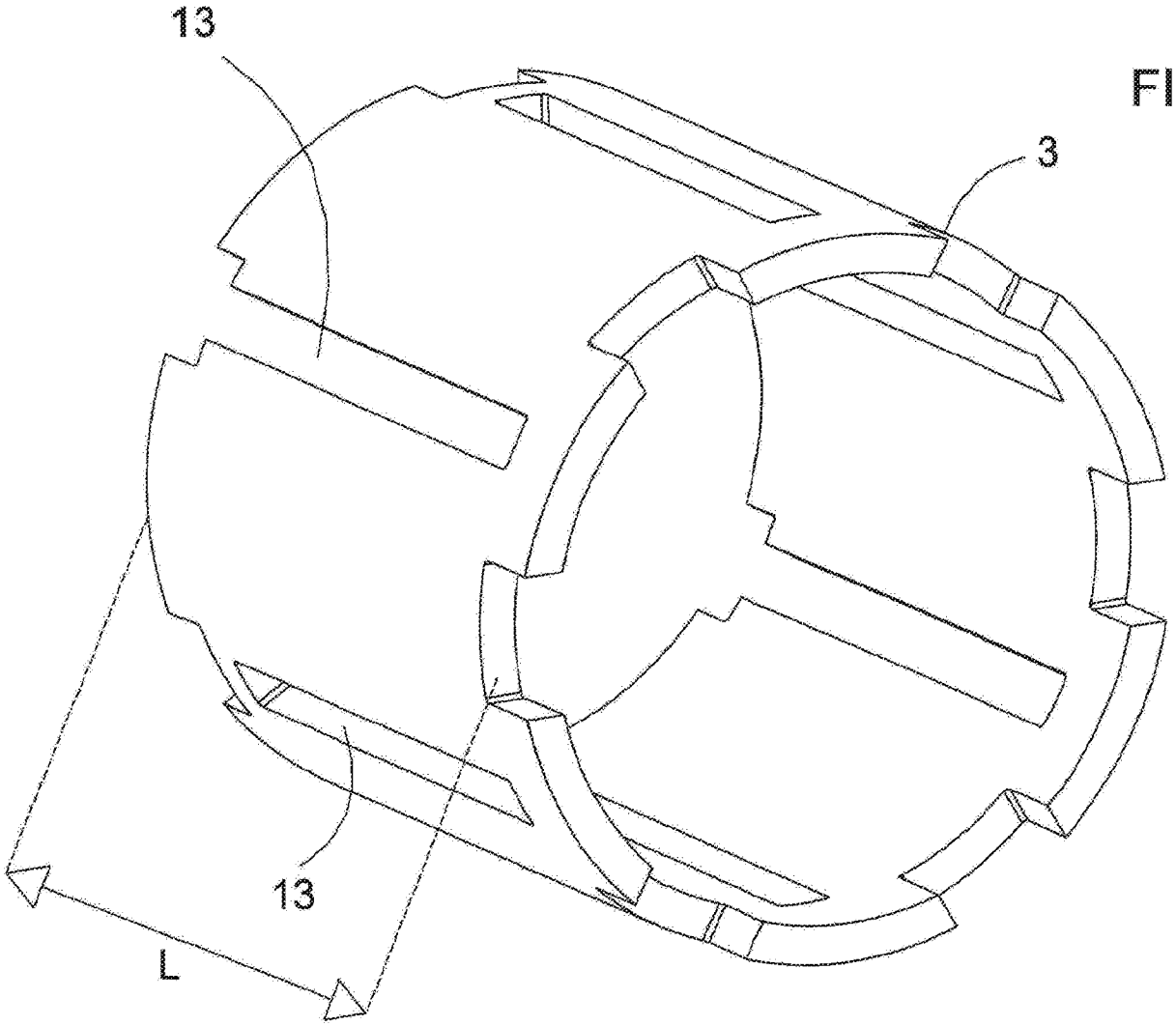
FIG. 4 shows a perspective view of the first hollow tubular casing of the lock of FIG. 1.

Moreover, the first hollow casing 3 comprises a plurality of first elongate notches 13 extending substantially along the length L of the first hollow casing 3. As can be clearly seen from FIG. 4 in particular, each first elongate notch 13 is disposed at a predetermined position on the periphery of the first hollow casing 3.

Turning now to the second hollow casing 5, this comprises a plurality of second elongate notches 15 extending substantially along the length L' of the second hollow casing 5, each second elongate notch 15 being disposed at a predetermined position on the periphery of the second hollow casing 5. As can be clearly seen from FIGS. 1, 1A and 1B in particular, each of the first elongate notches 13 overlaps with a corresponding second elongate notch 15.

Figure 5:
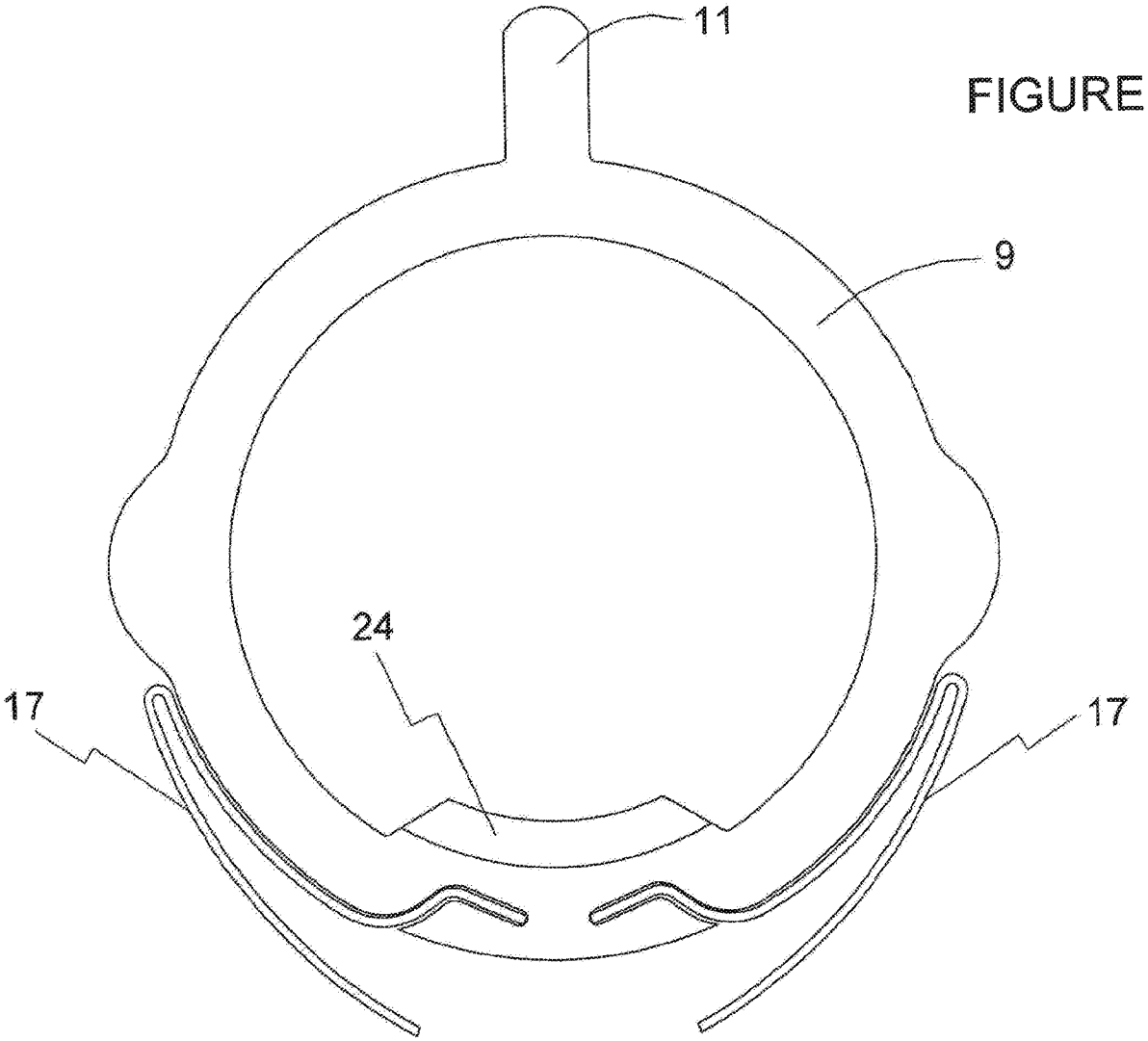
FIG. 5 shows a perspective view of an annular element forming part of the lock of FIG. 1.

The lock 1 further comprises a set of leaf springs 17 (see FIG. 5) each of which is mounted between the interior of the second hollow casing 5 and one of the annular elements 9, at a position that is diametrically opposite the elongate tab 11 of the annular element 9 upon which the leaf spring 17 is mounted. The leaf springs 17 are fixed to the annular elements 9 by being held in spring slots 18 which are cut into the annular element (see FIG. 2).

Each leaf spring 17 biases the corresponding elongate tab 11 diametrically opposite to it towards a locking condition in which the elongate tab 11 extends through both a first elongate notch 13 and its corresponding overlapping second elongate notch 15. In view of the fact that the elongate tab 11 extends through both the first elongate notch 13 and the second elongate notch 15, the rotation of the second hollow casing 5 within the first hollow casing 3, is prevented, effectively locking the second hollow casing 5 in position.

In order to move the lock 1 between the locking condition and the unlocking condition, a key 19 is provided. As can be seen from FIG. 3 in particular, the key 19 comprises a cylindrical member in the form of coding portion in the form of a barrel 21 comprising a plurality of raised biasing elements in the form of nubs or protrusions 23 disposed on the outer surface of the barrel 21.

It is to be appreciated that the key 19 is adapted to be inserted into the second hollow casing 5 such that, when the key 19 is inserted, the lock 1 moves towards the unlocking condition such that none of the tabs 11 are engaged with the first elongate notches 13. In particular, when the key 19 is disposed in the lock, each of the nubs 23 engages with a specific corresponding annular element 9, such as to move the elongate tab 11 of the annular element 9 out of engagement with the first elongate notch 13, against the biasing action of the leaf spring 17. This movement results from an engagement of the nub 23 with a cam surface 24 which extends radially inward of the inner circumference of the annular member 9.

It is to be appreciated that in this way, each lock is "coded" such that the positions of the nubs 23 along the length of the matching key 19 are such that they are diametrically opposite to an elongate tab 11 on a particular annular element 9, when the correct key 19 is fully inserted into the lock 1.

It is also to be appreciated that the coding of the lock can be changed by rotating the annular members 9 such that the elongate tabs 11 engage with different first 13 and second 15 elongate slots, or by moving the position of the annular member 9 longitudinally along the lock 1.

In this way, the more first 13 and hence second 15 elongate notches and hence annular members 9 and their associated elongate tabs 11 there are in a particular lock 1, the more potential codes exist. Moreover, it is to be appreciated that the more first 13 and hence second 15 elongate notches and hence annular members 9 and their associated elongate tabs 11 there are in a particular lock 1, the stronger the lock 1 is, in terms of a higher shear force being required to force the lock 1 into the unlocking condition with an unauthorised key.

It is also to be appreciated that the key 19 is designed such that each nub 23 is disposed on the barrel 21 at a specific predetermined position so that when the key 19 is fully inserted into the lock 1, the nub 23 is at the correct position relative to the periphery of the annular element 9 which it is intended to bias towards the unlocking condition. That is, when the key 19 is fully inserted into the lock 1, each nub 23 is disposed at a position diametrically opposite to the elongate tab 11 on the annular element 9 with which the nub 23 is intended to interact. In this way, the nub 23 acts against the associated leaf spring 17 and pushes against the cam surface 24 thereby moving the annular element 9 out of engagement with the first hollow casing 3, in order to move the lock 1 to the unlocking condition.

Figure 3:
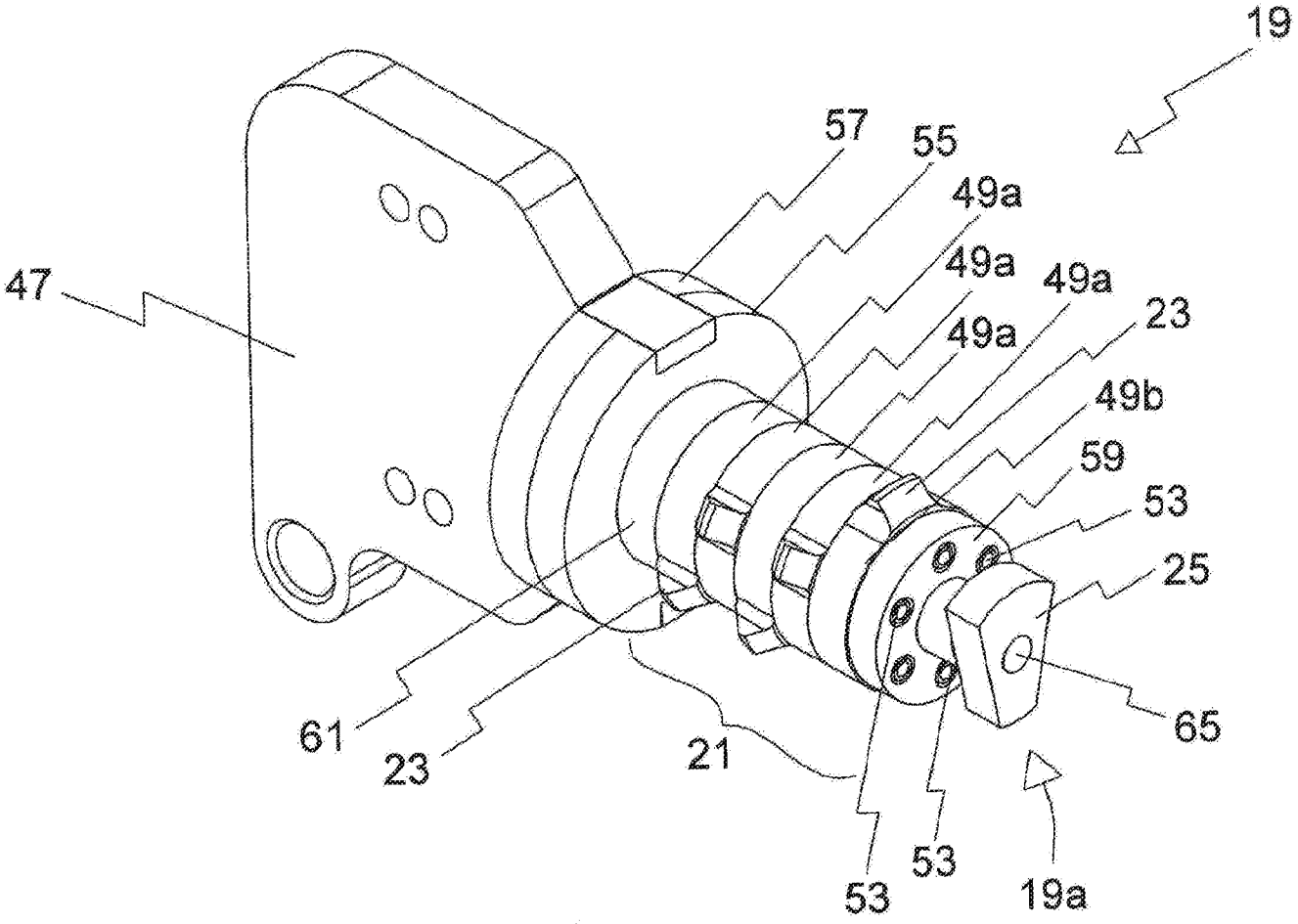
FIGS. 3 and 3A show a perspective view and an exploded perspective view of a key for use with the lock of FIG. 1.
Figure 3A:
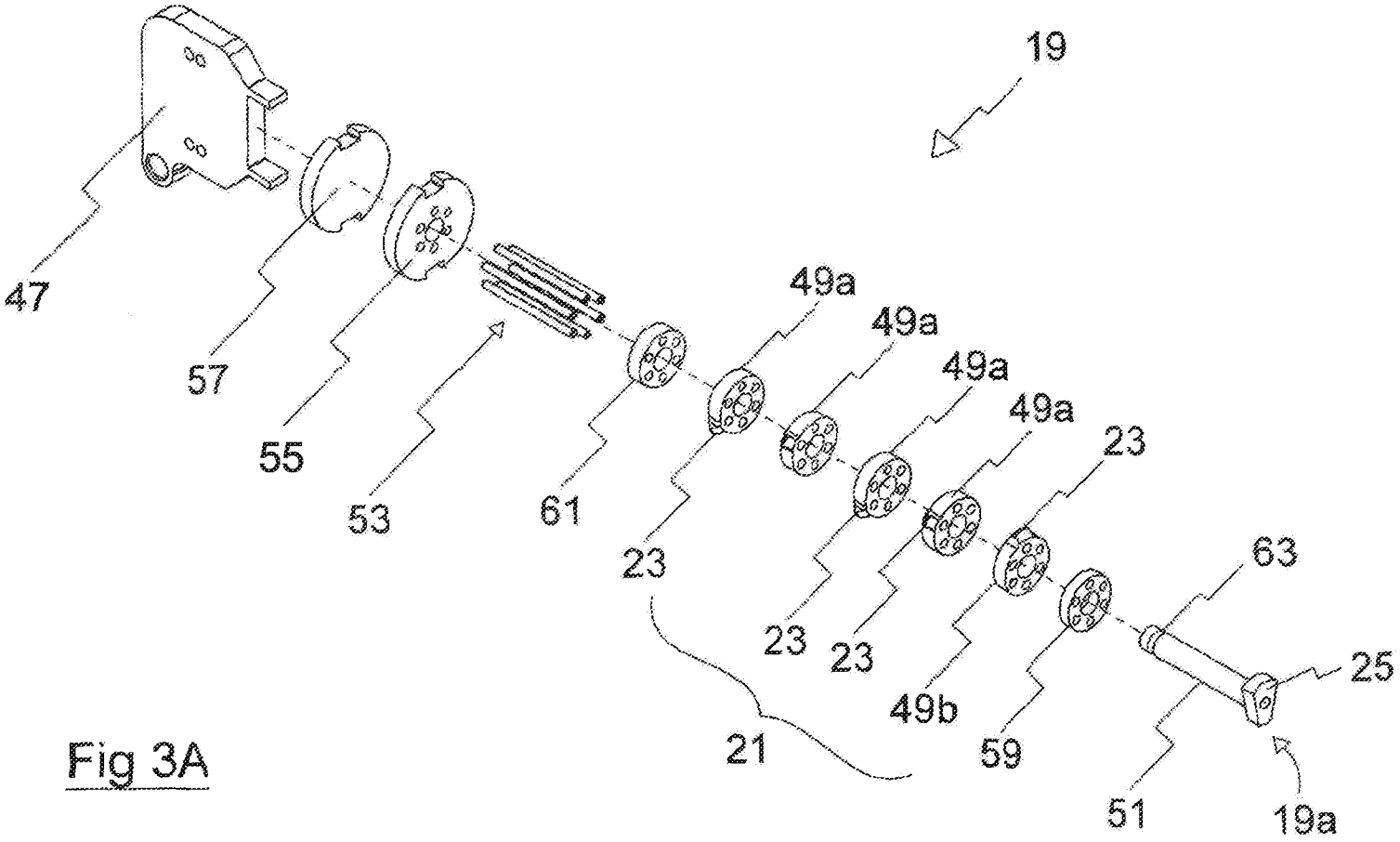

As can be seen from FIGS. 3 and 3A in particular, the key 19 further comprises a driving portion in the form of a wedge shaped element 25 at its distal end 19*a*, which, when the key 19 is disposed inside the lock 1, engages with the closed end 27 of the second hollow casing 5. In particular, when the key 19 is disposed inside the lock 1, the wedge shaped element 25 locates inside a driven portion which is a correspondingly sized and shaped slot 29 in the closed end 27. In this way, when the key 19 is inside the lock, and the key 19 is rotated, the wedge shaped element 25 (the driving portion) causes the rotation of the slot 29 (the driven portion) in turn causing the rotation of the closed end 27 of the second hollow casing 5 which therefore also rotates.

By means of example, it is to be appreciated that the key 19 and hence the second hollow casing 5 has 90 degrees of rotational movement when inside the lock 1.

It is to be appreciated that, as an alternative to the wedge shaped element 25, the key 19 could comprise a T-shaped element, for example.

The lock 1 is adapted such that, in the event that the lock 1 moves from its locking condition to its unlocking condition and the second hollow casing 5 is rotated by means of turning the key 19, the key 19 cannot be removed from the lock 1 until the key 19 and consequently the second hollow casing 5, is rotated back to the locking condition. In this way, the lock 1 operates as a trapped key lock and specifically a trapped key interlock. In order to effect this, the lock 1 comprises a key trapping element in the form of a disk 31 disposed adjacent the closed end 27 of the second hollow casing 5. The disk 31 itself comprises a wedge shaped aperture 33 which, when the lock 1 is in the locking condition, overlaps with the wedge shaped slot 29 of the closed end 27 of the second hollow casing 5.

The disk 31 is substantially fixed in position such that it does not rotate in the event that the second hollow casing 5 is rotated by means of turning the key 19.

In this way, as the key 19 is inserted into the lock 1, the wedge shaped element 25 of the key 19 passes through the aperture 33 of the disk 31 and engages with the wedge shaped slot 29 of the closed end 27 of the second hollow casing 5. When the key 19 is then turned, the second hollow casing 5 rotates within the first hollow casing 3 towards the unlocking condition and the key 19 becomes trapped, with the wedge shaped element 25 effectively becoming trapped in the gap between the closed end 27 of the second hollow casing 5 and the disk 31, since the aperture 33 of the disk 31 is at that stage, no longer overlapping with the slot 29 of the closed end 27 of the second hollow casing 5.

It is to be appreciated that as soon as the key 19 begins to turn, that is, as soon as the aperture 33 of the disk 31 is tilted with respect to the slot 29 of the closed end 27, the key 19 becomes trapped.

Figure 1B:
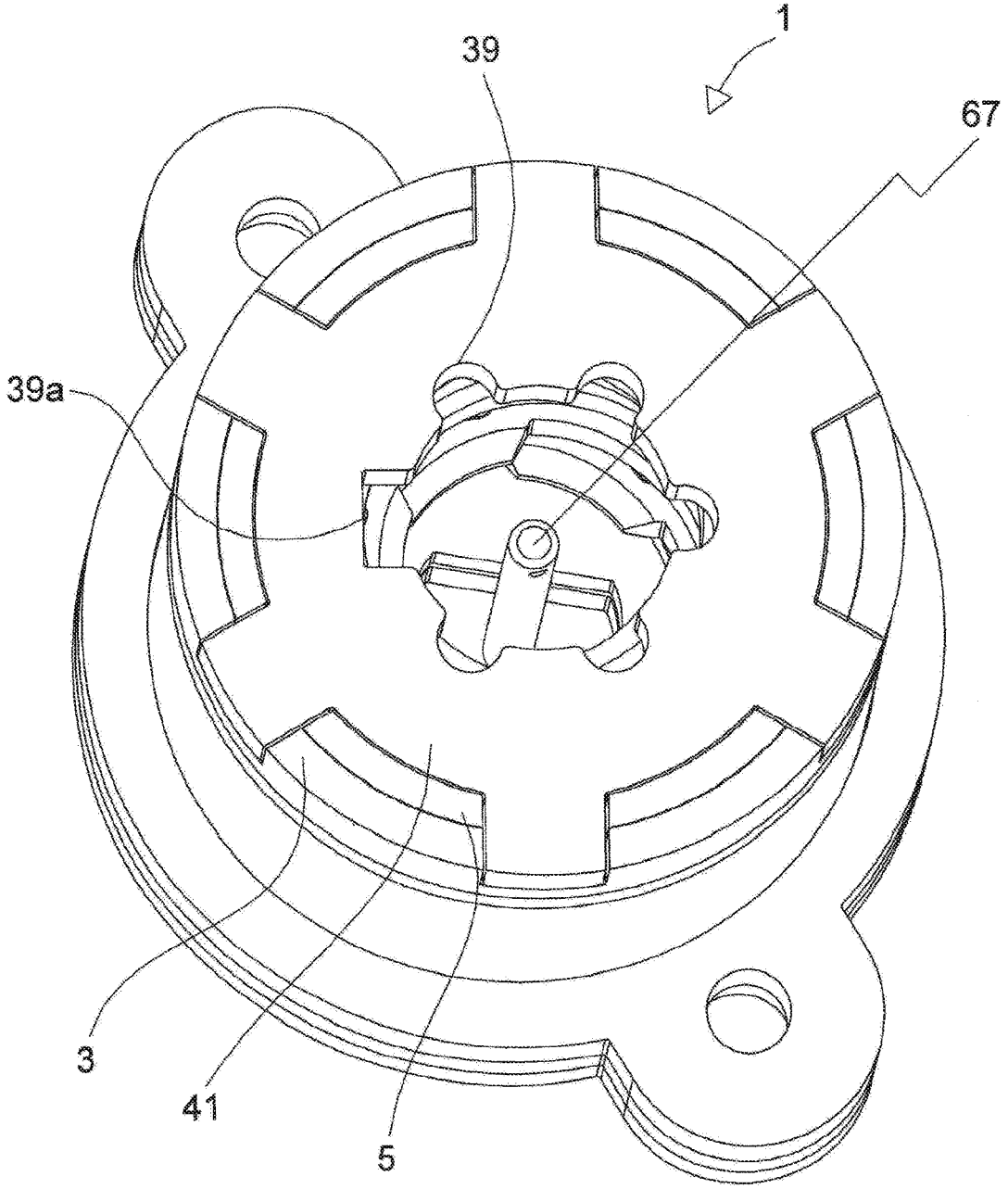

As can be clearly seen from FIGS. 1, 1A and 1B, the lock 1 further comprises a front face 41 comprising a key slot 39. The key slot 39 is sized and shaped to facilitate the entry of the key 19 into the lock 1, and in particular, is shaped such that the key 19 can only be inserted into the lock 1 in a particular rotational orientation. This is effected by means of a lead slot 39*a* having the same size and shape as a corresponding projection 49*b* on the key 19.

Returning to FIGS. 3 and 3A, the key 19 has a handling portion in the form of a handle 47 for engagement or grasping by an operator. The coding portion or barrel 21 is formed from a series (in this example 5) circular coding members 49*a* and 49*b* (and generally referred to as 49). The coding members 49 are substantially identical to each other except that the nub 23 on coding member 49*b* is wider (that is extending around a greater proportion of the circumference of the circular coding member) than those on the coding members 49*a* so as to only be able to enter the lock through the lead slot 39*a*.

The coding members 49 are mounted on a central body member 51 as well as on six coding pins 53 with the central body member 51 and the coding pins 53 extending into apertures in a first end plate 55 which together with a second end plate 57 are attached to the handle 47. The final components of the key 19 are end caps 59 and 61 which are located at either end of the coding portion 21. Each of the coding members 49 as well as the end caps 59 and 61 have a series of apertures corresponding to the coding pins 53 so that these components are combined together by sliding the components onto the pins 53 and locating the central body member 51 down the central aperture. As can be seen in FIG. 3A, on each of the coding members 49 the nub 23 is located adjacent one of the apertures through which a coding pin 53 will extend. Different keys can be produced by rotating each of the coding members 49 such that the nub 23 is located adjacent a different coding pin 53. Furthermore, additional codes can be added by replacing one or more of the coding members 49 with a similar coding member where the nub 23 is not located immediately adjacent an aperture for a coding pin but is, for example, located between two apertures. It should be noted that if these alternative coding members 49 are used corresponding changes, in particular to the positions of the slots will need to be made to the first and second tubular casings 3 and 5.

Furthermore, additional coding variations can be created by varying the shape of the shaped driving element 25. For example, by replacing the wedge shape shown in the figures with an alternative shape, such as a star shape, all of the codes for the wedge shaped keys could be repeated for the star shaped keys since even if a wedge shaped key and a star shaped key had the same arrangement of coding members their respective shaped driving elements 25 would not fit thereby preventing one key from being able to operate another lock.

The central body member 51, which holds the shaped driving element 25, has a point of weakness, indicated at 63, in the form of an annular channel cut into the central body member. This annular channel 53 acts as a shear or weak point which will break under a predetermined excessive turning force being applied to the handle 47. The annular channel 63 is located roughly between the first and second end plates 55 and 57 so that in the event of the key breaking the majority of the key is left in the lock and can be relatively easily reached for complete extraction of the key.

The key 19 is also provided with an elongate aperture 65 which extends through the shaped driving element 25 and into the central body member 51. When the key is inserted into the lock this aperture 65 receives a central pin 67 which extends from the back of the lock on the axis of rotation of the lock and through the slot 29 and aperture 23. This pin 67 adds a further obstacle to anyone attempting to gain access to the driven portion, that is, the shaped slot 29, making it even more difficult to apply a turning force to the driven portion.

It will be appreciated by persons skilled in the art that the above embodiment has been described by way of example only, and not in any limitative sense, and that various alterations and modifications are possible without departing from the scope of the invention as defined by the appended claims. In particular, it should be noted that although the above embodiment has been described specifically for use with trapped key interlocks, the same apparatus can be used to create a standard locking device.

The invention claimed is:

1. A trapped key interlock system comprising:

a lock comprising:

a first hollow casing;

a second hollow casing disposed within a hollow portion of the first hollow casing; and a lock portion mounted within the second hollow casing; and a key for moving said lock between a locking condition and an unlocking condition, said key comprising a cylindrical member comprising an outer surface and having a plurality of biasing elements disposed on the outer surface and a shaped member attached to said cylindrical member;

wherein the lock portion comprises a plurality of annular elements arranged side by side, each said annular element comprising an engaging member extending radially outwards from a periphery of the annular element, wherein the first hollow casing comprises a plurality of first elongate notches extending substantially along a length of the first hollow casing, each first elongate notch disposed at a predetermined position on a periphery of the first hollow casing, wherein the second hollow casing comprises a plurality of second elongate notches extending substantially along a length of the second hollow casing, each second elongate notch disposed at a predetermined position on a periphery of the second hollow casing such that, when said lock is in said locking condition, each of the first elongate notches substantially overlaps with a corresponding second elongate notch, wherein each said engaging member is biased towards a position whereby said engaging member is disposed within one of said first elongate notches and its corresponding overlapping second elongate notch, defining said locking condition in which rotational movement of said second hollow casing within said first hollow casing is prevented, wherein said lock is movable between said locking condition and said unlocking condition in which at least one said engaging member is disposed within a second elongate notch, but is not engaged with its corresponding overlapping first elongate notch, to allow for rotational movement of said second hollow casing within said first hollow casing, wherein said second hollow casing has a closed end comprising a first slot such that, when the key has been disposed inside the second hollow casing, a portion of the shaped member engages with the first slow of the closed end, so that, when the key is rotated, the second hollow casing also rotates; and a key trapping element comprising a disk disposed adjacent the closed end of the second hollow casing, said disk comprising a second slot which, when said lock is in said locking condition, overlaps with said first slot; and wherein when the second hollow casing is rotated by the key, said disk does not rotate such that when the lock moves from the locking condition to the unlocking condition, the key cannot removed from the lock until the key is rotated back to the locking condition.

2. A trapped key interlock system as claimed in claim 1, wherein each said engaging member is biased towards the locking condition in which said engaging member is disposed within one of said first elongate notches and its corresponding second elongate notch, by means of a leaf spring.

3. A trapped key interlock system as claimed in claim 2, wherein each said leaf spring is attached to said annular element and is disposed between interior of said second hollow casing and said annular element at a position on said annular element diametrically opposite the engaging member of that annular element.

4. A trapped key interlock system as claimed in claim 1, wherein each said engaging member is biased towards the locking condition in which said engaging member is disposed within one of said first elongate notches and its corresponding second elongate notch, by means of a spring.

5. A trapped key interlock system as claimed in claim 4, wherein each said spring is mounted between an interior of said second hollow casing and one of said annular elements, at a position on said annular element diametrically opposite the engaging member of that annular element.

6. A trapped key interlock system as claimed in claim 1, wherein said key is adapted to be inserted into the second hollow casing such that, when said key is inserted into said second hollow casing, said lock moves towards the unlocking condition such that none of said engaging members are engaged with the first elongate notches.

7. A trapped key interlock system as claimed in claim 1, wherein said plurality of biasing elements are disposed on said outer surface of said cylindrical member of said key such that, when said key is disposed in said lock, each said biasing element engages with a corresponding annular element such as to move said engaging member out of engagement with its corresponding first elongate notch.

8. A trapped key interlock system as claimed in claim 1, wherein said plurality of biasing elements are disposed on said outer surface of said cylindrical member of said key such that, when said key is disposed in said lock, each said biasing element is disposed diametrically opposite the engaging member of the annular element with which the biasing element engages.

9. A trapped key interlock system as claimed in claim 1, wherein said key includes a built in weakness, disposed at a position on the key adjacent an end of the cylindrical member that is opposite, the shaped member.

* * * * *